US005957571A

United States Patent [19]

Koster et al.

[11] Patent Number: 5,957,571

[45] Date of Patent: Sep. 28, 1999

[54] REFLECTOR LAMP

[75] Inventors: Marinus P. Koster; Arnoldus M.C. Kieboom; Johannes A.A.M. Van Heeswijk; Ay L. De Goederenoei; Georges M. Calon, all of Eindhoven, Netherlands

[73] Assignee: U.S. Philips Corporation, New York, N.Y.

[21] Appl. No.: 08/925,283

[22] Filed: Sep. 8, 1997

[30] Foreign Application Priority Data

Sep. 11, 1996 [EP] European Pat. Off. ..... 96202535

[51] Int. Cl.[6] ..... F21V 7/00

[52] U.S. Cl. ..... 362/306; 362/263; 362/310

[58] Field of Search ..... 362/306, 310, 362/350, 264, 285, 294, 296, 288, 226, 373, 347; 313/113

[56] References Cited

U.S. PATENT DOCUMENTS 5,109,181 4/1992 Fischer et al. ..... 313/571
5,497,049 3/1996 Fischer ..... 313/634
5,506,464 4/1996 Ooms ..... 313/113
5,568,967 10/1996 Sikkens et al. ..... 362/328
5,744,901 4/1998 Friederichs et al. ..... 313/113

*Primary Examiner*—Sandra O'Shea
*Assistant Examiner*—Todd Reed Hopper
*Attorney, Agent, or Firm*—F. Brice Faller

[57] ABSTRACT

The reflector lamp has a reflector body (1) having a neck-shaped portion (4) with an end face (5). An electric lamp (10) having a lamp vessel (11) with elongate end portions (12,13) and in which an electric element (14) is present, is mounted inside the reflector body (1), its first end portion (12) being fixed in the neck-shaped portion (4) and its electric element (14) being aligned with respect to the optical axis (3) of the reflector body (1). The lamp (10) is fixed by means of a first (30) and a second clamping member (40), which are initially movable with respect to the lamp (10) and one to the other, and which are rigidly secured one to the other after alignment of the electric element (14). The first clamping member (30) is kept positioned against the end face (5).

18 Claims, 5 Drawing Sheets

REFLECTOR LAMP

BACKGROUND OF THE INVENTION

The invention relates to a reflector lamp comprising:

a reflector body with a concave reflecting portion having an optical axis, and a neck-shaped portion having an end face transverse to the optical axis and an outer surface surrounding the optical axis;

an electric lamp with a lamp vessel which is closed in a vacuumtight manner and which has a first and a second elongate end portion, the end portions facing away from one another, an electric element arranged in the lamp vessel, and current conductors extending through the respective first and second end portions to the electric element, a lamp cap around the neck-shaped portion and fastened thereto, the lamp vessel being fastened by its first end portion in the neck-shaped portion, while the electric element occupies a predetermined position relative to the optical axis.

Such a reflector lamp is known, for example, from U.S. Pat. No. 5,506,464 and U.S. Pat. No. 5,568,967. Electric lamps which may be used in the reflector lamp are known from, for example, U.S. Pat. No. 5,109,181 and U.S. Pat. No. 5,497,049.

The electric lamp is secured with cement in the neck-shaped portion of the reflector body in the known reflector lamp, after having been aligned. This is a disadvantage because the curing of the cement keeps the equipment in which the lamp has been aligned in use during a considerably longer period than is necessary for the alignment proper. Another disadvantage is that the cement may crumble in the long run and no longer hold on to the lamp securely, and that the cement may give off volatile ingredients which may impair the reflectivity of the reflector body. It is also possible for the cement to change the position of the lamp during the cement-curing phase.

SUMMARY OF THE INVENTION

It is an object of the invention to provide a reflector lamp in which the electric lamp is securely held in alignment by mechanical means.

According to the invention, a first and a second clamping member comprising a first and a second cylinder arranged in tandem and provided with a first and a second transverse flange, respectively, are present with clamping fit around the first end portion.

The first cylinder has a first, a second, and a third cooperating clamping element, which elements are substantially situated in one cross-section, the first and the second flange being in mutually facing relationship rigidly coupled to one another, and the first flange being held in position against the end face of the reflector body.

During assembling of the reflector lamp, the lamp vessel may be introduced into the reflector body, for example together with the clamping members, at the end face through the neck-shaped portion. The first flange is pressed against the end face. The lamp is ignited and the first end portion is manipulated until the electric element has reached its predetermined position. This may become apparent, for example, from the shape of a light beam formed by the lamp. The lamp vessel may be displaced axially during manipulation, may be rotated about an axis of its own, and may be pivoted. Pivoting is possible in two directions perpendicular to the optical axis because the first clamping member behaves like a ball joint. Once found, the lamp position is fixed by coupling the first and the second clamping member.

It is favorable for the simplicity of the construction of the reflector lamp, and also for the simplicity of lamp manipulation, and possibly for the simplicity of a tool used for this, when the second clamping member is further remote from the electric element than the first clamping member, and the second clamping member, too comprises a first, a second, and a third cooperating clamping element situated substantially in one cross-section and accordingly acting as a ball joint. It suffices then to displace the second clamping member in a flat plane only for positioning the lamp in the directions perpendicular to the optical axis. The flange at the second clamping member may then be substantially parallel to the flange of the first clamping member.

It is favorable for a ball joint when three clamping elements are present. The joint then has substantially the same movability in all directions. The clamping members may nevertheless have additional clamping elements.

The first and the second flange may be coupled to one another by means of fixed welded tongues which were elastic prior to their fixation by welding. The tongues may be present at a separate member between the two clamping members, but it is favorable, inter alia for limiting the number of components, when the tongues are integral with the clamping members, for example with one of the clamping members. In particular, the tongues are integral with the second flange. They may then be observed from the outside for making the welds, for example laser welds.

It is favorable for the rigidity of the coupling when the tongues are arranged in several pairs of tongues which face away from one another, for example two or three such pairs. A pair of tongues then substantially forms a rigid, trapezium-shaped tube in conjunction with the flanges.

It is favorable when depressions in the first, and possibly in the second cylinder form clamping elements thereof. The depressions may be, for example, curved cylindrically transverse to the optical axis, but it is advantageous when they are spherically curved.

It will benefit the simplicity of the process of aligning the lamp when one of the clamping members has an anchor inhibiting an axial displacement of the clamping member along the first end portion. It is favorable when the second clamping member comprises said anchor. The lamp may then still be displaced axially together with the second clamping member, so that the electric element of the lamp is allowed to have a tolerance as to its position in axial direction relative to the lamp vessel, which can be corrected during alignment. The anchor is useful in the finished lamp because it fixes the position of the electric element in axial direction better and renders it shock-resistant.

The lamp vessel may be made from glass, for example glass having an $SiO_2$ content of at least 95% by weight such as, for example, quartz glass, or of ceramic material such as, for example, monocrystalline or polycrystalline $Al_2O_3$. The lamp vessel may be, for example, substantially cylindrical, or have substantially cylindrical end portions. It is also possible for the lamp vessel to have an outer envelope which may be, for example, cylindrical. In an embodiment, a tubular member is fixed around the first end portion, the first and the second clamping member cooperating with cylindrical longitudinal portions thereof. The tubular member may be made, for example, from metal and clamp around the end portion, or may alternatively be made from glass, for example lamp vessel glass, for example quartz glass. The member may have collapsed, for example, over one or several longitudinal portions onto the lamp vessel and have been fused thereto.

The anchor may be a spring which grips into a tangential groove in the tubular member. Alternatively, the anchor may be a clamp which grips around the end portion. A tangential groove has the advantage over a transverse groove that it restricts a rotation of the lamp vessel relative to the second clamping member.

The first flange may comprise one or several elements which fittingly grip into or around the neck-shaped portion of the reflector body at the end face thereof. The reflector body may be made, for example, from metal or, for example, from glass. Especially in the latter case, however, the dimension of the neck-shaped portion may be subject to tolerances which could lead to the lamp being shifted after alignment. In a favorable embodiment, the end face of the reflector body has radially directed grooves, and the first flange of the first clamping member has projections which each grip into a respective groove. In particular, the end face has V-shaped grooves, and the projections each have a spherically curved surface. Advantageously, but not necessarily, the grooves are evenly distributed over the end face.

This embodiment has the advantage that the first flange pressed against the end face can have substantially only one position relative to that end face because only in that position does it project deepest with its projections into the grooves.

It is favorable when the first flange is held pressed against the end face by means of a resilient member. The resilient member may be a separate body. Alternatively, it may be integral with the second clamping member and press itself against the lamp cap. It is favorable, however, when the resilient member is integral with the lamp cap. No separate component is necessary in that case.

The lamp cap may be fixed to the reflector body, for example, by means of bulges which enter recesses. In a favorable embodiment, the outer surface of the neck-shaped portion of the reflector body has recesses into which projections of a split metal ring grip, and the lamp cap is welded to said ring. In particular, the metal ring has bulges pressed outwards on either side of the projections, which bulges press against the lamp cap. This embodiment, and in particular its modification, has the advantage that a substantially immovable coupling can be obtained. The projections may be provided beforehand and thus give the ring an excess dimension. When the lamp cap is pressed around the ring, the ring will be compressed. The ring thus has a good contact on the one hand to the lamp cap and on the other hand to the reflector body, and also a good grip thereon. It is alternatively possible that the ring, for example, has straight portions with the projections for cooperation with recesses, alternating with circular-arc portions on which welded joints with the lamp cap can be made.

The electric element of the lamp may be an incandescent body, possibly in an inert gas comprising halogen, or a pair of electrodes in an ionizable medium, for example in rare gas, or rare gas and mercury and/or sodium, whether or not with metal halide added thereto, in which a high-pressure discharge is maintained during operation.

BRIEF DESCRIPTION OF THE DRAWINGS

Embodiments of the reflector lamp according to the invention are shown in the drawings, in which corresponding components have been given the same reference numerals. In the drawings.

DETAILED DESCRIPTION OF THE PREFERRED EMBODIMENTS

Figure 1:
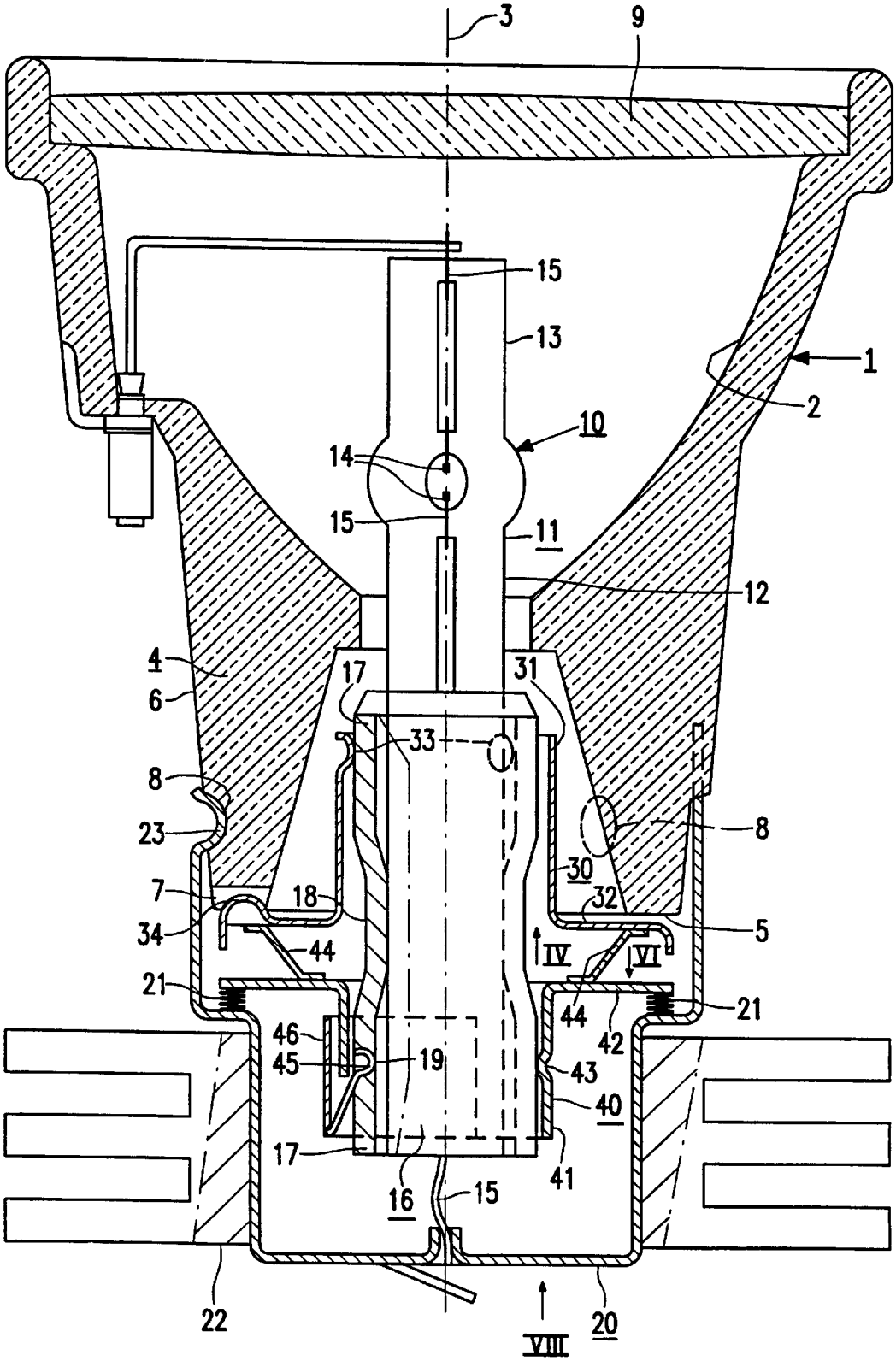
FIG. 1 is a diagrammatic axial sectional view of a first embodiment.

In FIG. 1, the reflector lamp has a reflector body 1 with a concave reflecting portion 2 having an optical axis 3, and a neck-shaped portion 4 having an end face 5 transverse to the optical axis 3 and an outer surface 6 surrounding the optical axis 3. The reflector body 1 in the Figure is made of glass and is closed with a (light transmitting) plate 9. The reflecting portion 2 has a coating of metal, for example aluminum or silver, or a light-reflecting interference filter.

An electric lamp 10 with a lamp vessel 11, which is closed in a vacuumtight manner, is made of quartz glass in the Figure, and has a first 12 and a second elongate end portion 13 facing away from one another, is arranged in the reflector body 1. An electric element 14, a pair of electrodes in an ionizable filling comprising rare gas and mercury in the Figure, is present in the lamp vessel 11, while current conductors 15 extend through the respective first 12 and second 13 end portions to the electric element 14. A lamp cap 20 is fastened around the neck-shaped portion 4, in the Figure by means of dents 23 which enter recesses 8 in the outer surface 6. The lamp vessel 11 is secured in the neck-shaped portion 4 by its first end portion 12. The electric element 14 thus occupies a predetermined position relative to the optical axis 3. The lamp cap 20 is surrounded by a body 22 which serves as a heat sink.

A first clamping member 30 and a second clamping member 40 with a first cylinder 31 and a second cylinder 41 and a first transverse flange 32 and a second transverse flange 42 connected to the respective cylinders are clamped around the first end portion 12. The first cylinder 31 has a first, a second, and a third cooperating clamping element 33, these elements lying substantially in one cross-section. The first 32 and the second flange 42 are rigidly coupled to one another, and the first flange 32 is held in position against the end face 5 of the reflector body 1.

The clamping elements 33, are spherically curved bulges. Which are evenly distributed over the circumference of the first cylinder 31 (120° Apart). During lamp alignment, the lamp 10 can be pivoted here as in a ball joint.

The second clamping member 40 is further remote from the electric element 14 than the first 30. The second cylinder 41 also has a first, a second, and a third cooperating clamping element 43 lying substantially in one cross-section and distributed over the circumference, each element here being a bulge, for example a transverse cylindrical one, only one of them being visible in the Figure. These elements 43 also form a ball joint. The flanges 32, 42 may as a result be mutually parallel while nevertheless the first end portion 12 is retained at an angle to the optical axis 3, and the flanges are transverse to the axis 3. Instead of the clamping elements 43 as shown and described, two such clamping elements 43 could be present in the Figure, situated one behind the other like the clamping elements 33, for retaining the first end portion 11 with clamping force together with a clamping member which also serves as an anchor 45.

The first flange 32 and the second flange 42 are coupled to one another by means of welded tongues 44 which are elastic prior to their fixation by welding. The tongues 44 in the Figure are separate components which are welded both to the first flange 32 and to the second flange 42. The clamping elements 33 lie at a comparatively great distance from the clamping elements 43, seen in axial direction, so that the lamp 10 is held in position in a very stable manner.

A tubular member 16 is fixed around the first end portion 12. It has cylindrical longitudinal portions 17 with which the first clamping member 30 and the second clamping member 40 cooperate. The tubular member 16 in the Figure is made of quartz glass, as is the lamp vessel 11, and is fused to the first and portion 12 over a longitudinal portion 18 thereof.

Of the first 30 and the second clamping member 40, it is the second 40 which has an anchor 45 against axial displacement of this clamping member 40 along the first end portion 12. The anchor 45 is a spring which grips into a tangential groove 19 in the tubular member 16. The anchor is present at a bracket 46 which is fastened, for example welded, to the second clamping member 40.

Figure 2:
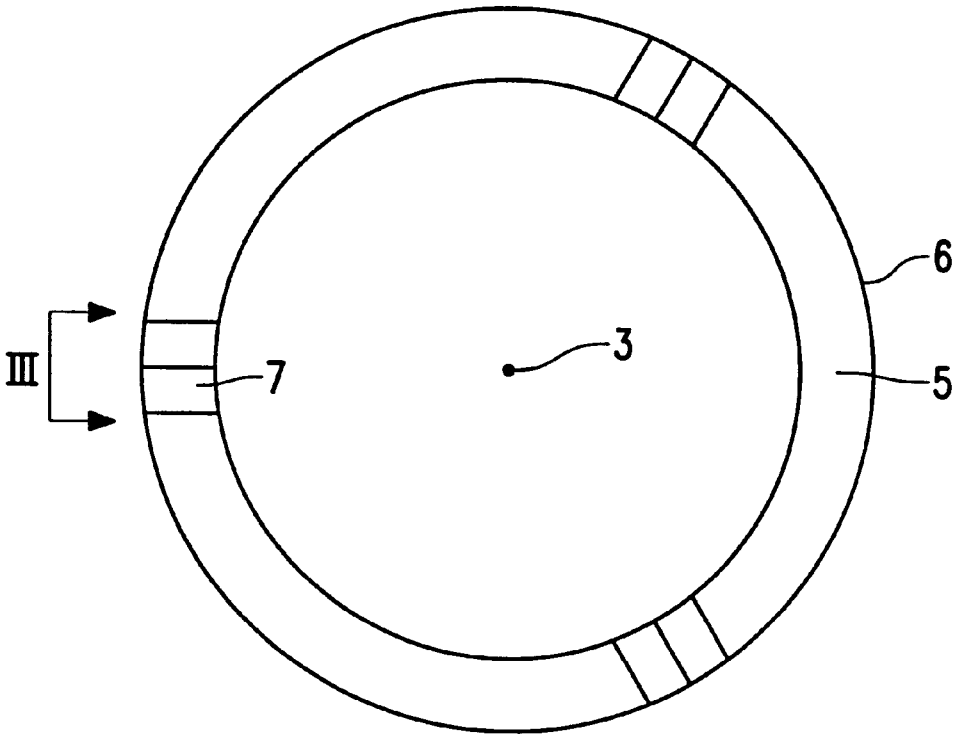
FIG. 2 is an elevation of the end face of the reflector body of FIG. 1.
Figure 3:
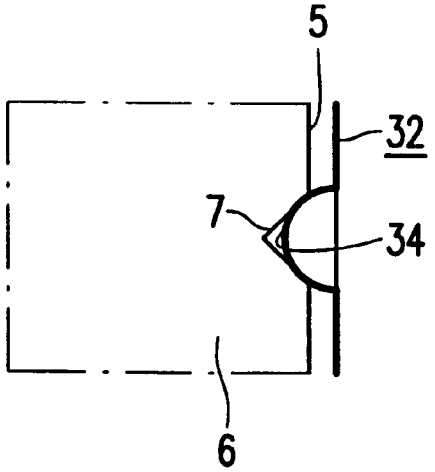
FIG. 3 is an elevation of the neck-shaped portion of the reflector body taken on the line III—III in FIG. 2.

The end face 5 of the reflector body 1 has radially directed grooves 7, see also FIGS. 2 and 3, which in the embodiment shown are equally distributed over the surface of the end face 5. The first flange 32 of the first clamping member 30 in the embodiment shown has three projections 34 which press into respective grooves 7. The projections 34 each have a spherically curved surface. They are pressed-out bulges in FIG. 1. The mutual positioning of the projections 34 implies that there is only one, centered position possible for the first flange 32 when it is pressed with its projections 34 into respective grooves 7 in a direction towards the end face 5.

A resilient member 21, a quadruple one in FIG. 1, presses the first flange 32 against the end face 5. The member 21 bears on the lamp cap 20 and on the second flange 42 which transmits the exerted pressure through the welded tongues 44 to the first flange 32.

Figure 4:
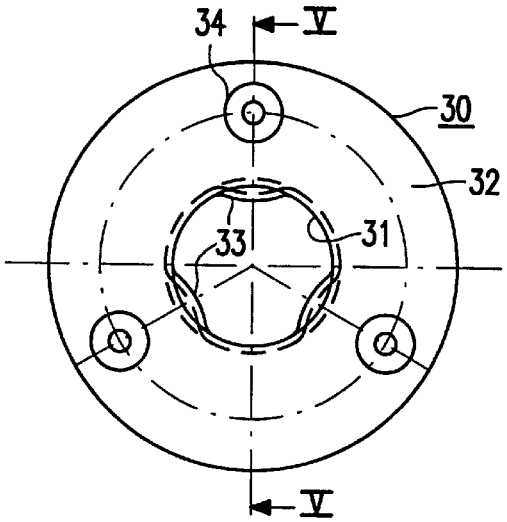
FIG. 4 shows an alternative embodiment of the first clamping member viewed along IV—IV.
Figure 5:
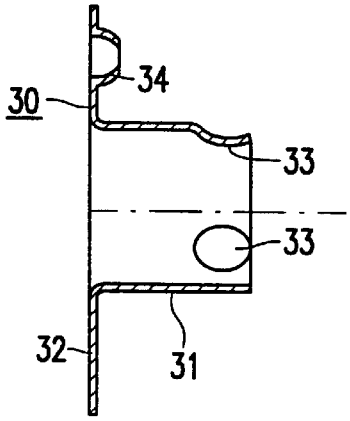
FIG. 5 shows the first clamping member taken on the line V—V in FIG. 4.

In FIGS. 4 and 5, the first clamping member 30 has a first cylinder 31 with three equally distributed, spherically curved bulges lying substantially in one transverse cross-section and acting as cooperating clamping elements 33. The first transverse flange 32 in the embodiment shown also has three equally distributed projections 34 which are to be accommodated in respective grooves 7 of the end face of a reflector body 1. The projections 34 are spherically curved, but they lack spherical tips.

Figure 6:
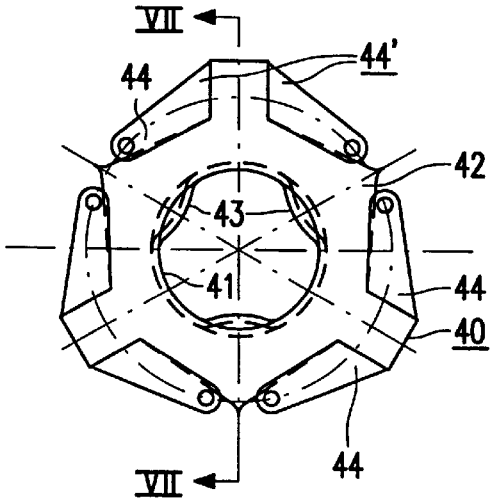
FIG. 6 shows an alternative embodiment of the second clamping member viewed along VI in FIG. 1.
Figure 7:
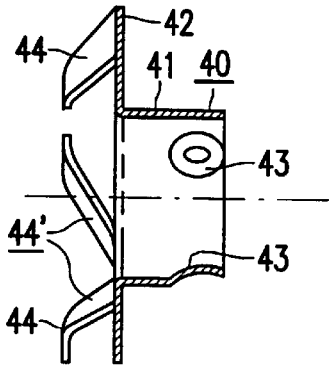
FIG. 7 shows the second clamping member taken on the line VII—VII in FIG. 6.

In the second clamping member 40 of FIGS. 6 and 7, the tongues 44 are integral with the second flange 42. The tongues 44 are arranged in several, three in the Figures, pairs 44', the tongues 44 of one pair 44' facing away from one another. The tongues 44 may be readily seen in a lamp of a FIG. 1 using this clamping member as the lamp cap 20 is absent.

Figure 8:
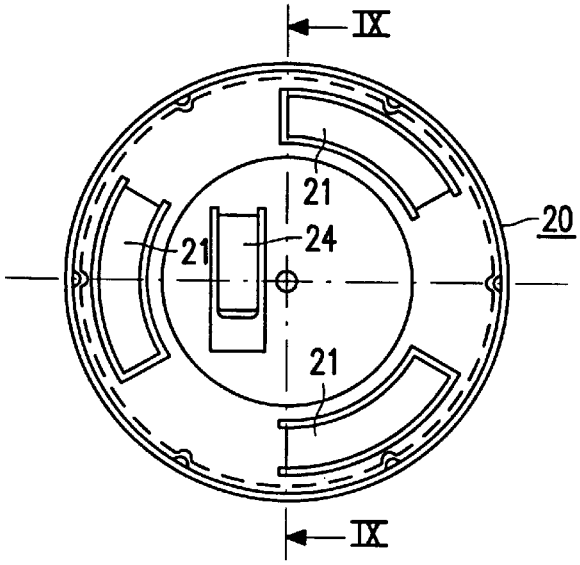
FIG. 8 shows an alternative embodiment of a lamp cap viewed along VIII in FIG. 1.
Figure 9:
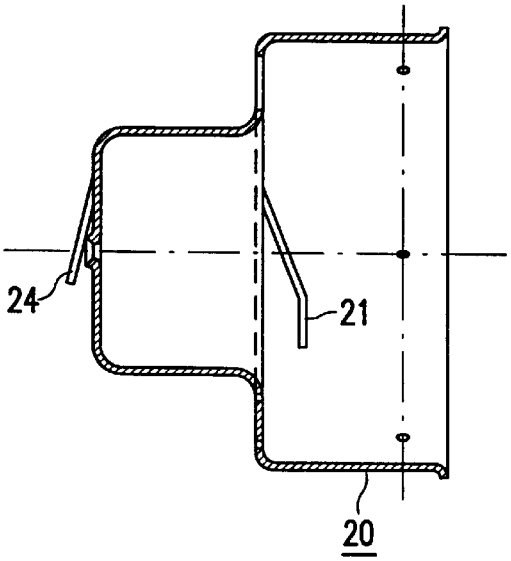
FIG. 9 shows the lamp cap taken on the line IX—IX in FIG. 8.

The lamp cap 20 in FIGS. 8 and 9 comprises a resilient member 21 which is integral with said cap and which is present in triplicate in the Figures. The resilient member 21 presses against the second flange 42 of the second clamping member 40 between the tongues 44 of one pair 44' in the finished lamp. The lamp cap 20 has a resilient tab 24 which is to make contact with an electric supply.

Figure 10:
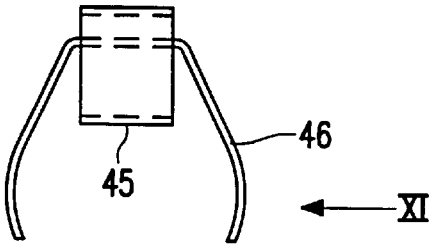
FIG. 10 shows an anchor for the clamping member of FIGS. 7 and 8 in axial elevation.
Figure 11:
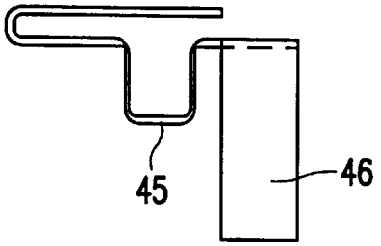
FIG. 11 is a cross-section taken on the line XI—XI in FIG. 10.

In FIGS. 10 and 11, the anchor 45 comprises a bracket 46 with which it can be fixed around the second cylinder 41 of the second clamping member 40. Since the anchor 45 can grip into a tangential groove 19, see FIG. 1, the second clamping member 40 is locked not only against an axial displacement relative to the lamp vessel 10, cf. FIG. 1, but also against a rotation after the anchor 45 has been mounted. It is thus possible to force the lamp 10 to carry out all desired movements during alignment by means of a manipulator which acts on the second clamping member 40.

Figure 12:
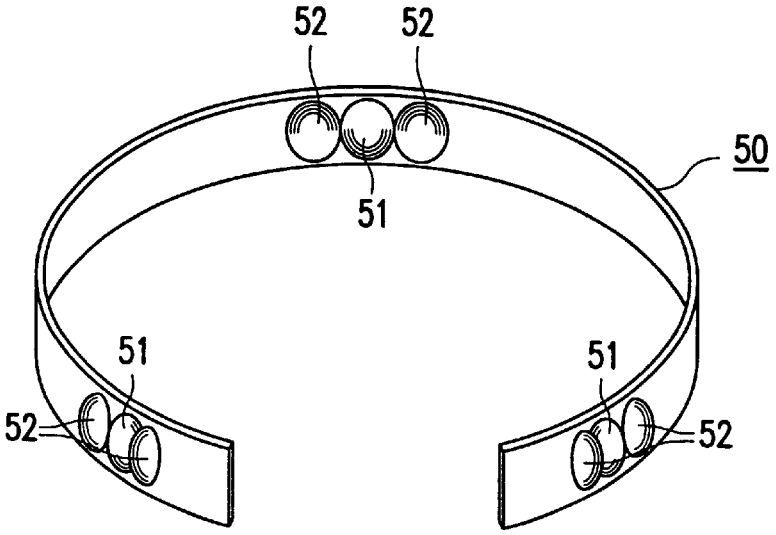
FIG. 12 shows a metal ring in perspective view.

The lamp cap 20 of FIGS. 8 and 9 may alternatively be fixed to the neck-shaped portion 4 of the reflector body 1, see FIG. 1, by means of a split metal ring 50, see FIG. 12, which is provided with projections 51 which enter recesses 8 in the outer surface 5 of the neck-shaped portion 4. When the lamp cap 20 is being applied, the ring 50 is compressed, and the lamp cap 20 can be welded to the ring 50. In the embodiment shown, the ring 50 has outward bulges 52 on either side of the projections 51, which bulges press against the lamp cap 20 and on which bulges, for example, welded joints may be made.

Figure 13:
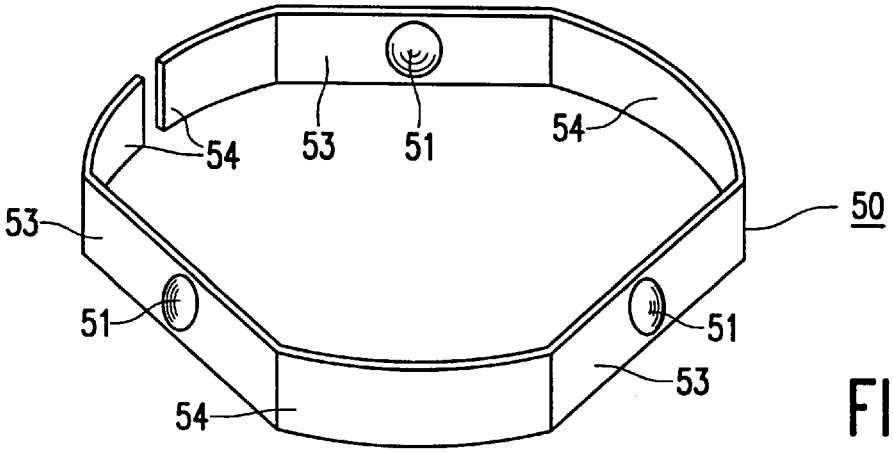
FIG. 13 shows another metal ring in perspective view.

In FIG. 13, the split metal ring 50 has projections 51 on straight portions 53 which are flanked by portions 54 in the shape of a circular arc. The portions 54 may press against the lamp cap 20, see FIG. 1, and may be fastened thereto, for example with laser welds.

We claim:

1. A reflector lamp comprising:

a reflector body (1) with a concave reflecting portion (2) having an optical axis (3), and a neck-shaped portion (4) having an end face (5) transverse to the optical axis (3) and an outer surface (6) surrounding the optical axis (3);

an electric lamp (10) with a lamp vessel (11) which is closed in a vacuumtight manner and which has a first elongate end portion (12) and a second elongate end portion (13), said end portions facing away from one another, an electric element (14) arranged in the lamp vessel (11), and current conductors (15) extending through the respective first (12) and second (13) end portions to the electric element (14), a lamp cap (20) around the neck-shaped portion (4) and fastened thereto, said lamp vessel (11) being fastened by its first end portion (12) in the neck-shaped portion (4), while the electric element (14) occupies a predetermined position relative to the optical axis (3), a first clamping member (30) comprising a first cylinder (31) having a first flange (32) transverse to said optical axis, and a second clamping member (40) comprising a second cylinder (41) having a second flange (42) transverse to said optical axis, said first and second clamping members being arranged in tandem with clamping fit around the first end portion (12), the first flange (32) facing said second flange (42), the first cylinder (31) having a first, a second, and a third cooperating clamping element (33), which elements are substantially situated in one cross-section, the first (32) and the second flange (42) being rigidly coupled to one another, and the first flange (32) being held in position against the end face (5) of the neck-shaped portion (4).

2. A reflector lamp as claimed in claim 1, wherein the second clamping member (40) is further remote from the electric element (14) than the first clamping member (30) and also the second cylinder (41) comprises a first, a second, and a third cooperating clamping element (43) situated substantially in one cross-section.

3. A reflector lamp as claimed in claim 1 wherein the first (32) and the second flange (42) are coupled to one another by means of fixed welded tongues (44) which were elastic prior to their fixation by welding.

4. A reflector lamp as claimed in claim 3, wherein the tongues (44) are integral with the second flange (42).

5. A reflector lamp as claimed in claim 3 wherein the tongues (44) are arranged in several pairs (44') of tongues (44) which face away from one another.

6. A reflector lamp as claimed in claim 1, wherein inward bulges in the first (31) and the second cylinder (41) form clamping elements (33, 43, respectively) thereof.

7. A reflector lamp as claimed in claim 6, wherein spherically curved bulges form the clamping elements (33, 43).

8. A reflector lamp as claimed in claim 1, wherein one of the first clamping member (30) and the second clamping member (40) has an anchor (45) inhibiting an axial displacement of said clamping member (30, 40) along the first end portion (12).

9. A reflector lamp as claimed in claim 1, wherein a tubular member (16) is fixed around the first end portion (12), the first (30) and the second clamping member (40) cooperating with cylindrical longitudinal portions (17) of said tubular member.

10. A reflector lamp as claimed in claim 9, wherein the tubular member (16) and the lamp vessel (11) are made of quartz glass, and the tubular member (16) has a longitudinal portion (18) which is fused to the first end portion (12).

11. A reflector lamp as claimed in claim 8 wherein said anchor (45) is a spring which grips into a tangential groove (19) in the tubular member (16).

12. A reflector lamp as claimed in claim 1, wherein the end face (5) of the reflector body (1) has radially directed grooves (7), and the first flange (32) of the first clamping member has projections (34) which each grip into a respective groove (7).

13. A reflector lamp as claimed in claim 12, wherein the projections (34) each have a spherically curved surface.

14. A reflector lamp as claimed in claim 12, wherein a resilient member (21) presses the first flange (32) against the end face (5).

15. A reflector lamp as claimed in claim 14, wherein the resilient member (21) is integral with the lamp cap (20).

16. A reflector lamp as claimed in claim 1, wherein the outer surface (6) of the neck-shaped portion (4) of the reflector body (1) has recesses (8) into which projections (51) of a split metal ring (50) grip, and the lamp cap (20) is welded to said ring (50).

17. A reflector lamp as claimed in claim 16, wherein outward bulges (52) are present on either side of the projections (51), which bulges press against the lamp cap (20).

18. A reflector lamp as claimed in claim 16, wherein the projections (51) are situated on straight portions (53) which are flanked by portions (54) which each have the shape of a circular arc.

* * * * *